United States Patent [19]

Ohshima et al.

[11] Patent Number: 4,510,034

[45] Date of Patent: Apr. 9, 1985

[54] COATING TYPE INSOLUBLE LEAD DIOXIDE ANODE

[75] Inventors: Shohzo Ohshima; Mikio Kusuda; Toshiro Isoya, all of Nobeoka, Japan

[73] Assignee: Asahi Kasei Kogyo Kabushiki Kaisha, Osaka, Japan

[21] Appl. No.: 413,230

[22] Filed: Aug. 31, 1982

[51] Int. Cl.[3] ..... C25B 11/00; C25B 1/02

[52] U.S. Cl. ..... 204/290 F; 204/129

[58] Field of Search ..... 204/284, 290 R, 14 R, 204/40, 47, 53, 283, 242, 29, 42, 290 F; 429/225; 427/124, 123, 126

[56] References Cited

U.S. PATENT DOCUMENTS

| | | | |
|---|---|---|---|
| 3,207,679 | 9/1965 | Schmidt | 204/42 |
| 3,671,415 | 6/1972 | King et al. | 204/284 |
| 3,947,333 | 3/1976 | Bianchi et al. | 204/129 |
| 4,005,003 | 1/1977 | Popplewell et al. | 204/290 F |
| 4,008,144 | 2/1977 | Torikai et al. | 204/290 R |
| 4,064,035 | 12/1977 | Fukasawa | 204/290 R |
| 4,127,468 | 11/1978 | Alfenaar et al. | 204/284 |
| 4,138,510 | 2/1979 | Koziol et al. | 427/124 |
| 4,297,421 | 10/1981 | Turillon et al. | 429/225 |
| 4,326,943 | 4/1982 | Bänziger et al. | 204/290 F |
| 4,354,915 | 10/1982 | Stachurski et al. | 204/242 |
| 4,415,441 | 11/1983 | Kanai et al. | 204/29 |

*Primary Examiner*—John F. Niebling

*Attorney, Agent, or Firm*—Armstrong, Nikaido, Marmelstein & Kubovcik

[57] ABSTRACT

A coating type insoluble lead dioxide anode comprising a porous metal substrate and a lead dioxide electrode layer coated on at least the outer surface of said substrate and the peripheral edges of the openings of pores in the substrate through an intermediate coating layer of a metal or a metal oxide. The inner wall surfaces of said pores may preferably coated with said lead dioxide electrode layer through said intermediate layer, and it is more preferable that the interiors of said pores are filled with lead dioxide.

11 Claims, 4 Drawing Figures

COATING TYPE INSOLUBLE LEAD DIOXIDE ANODE

BACKGROUND OF THE INVENTION

1. Field of the Invention

This invention relates to an insoluble anode provided with a porous metal substrate. More specifically, it relates to a coating type insoluble lead dioxide anode in which a porous metal is used as a substrate and which is for oxygen generation by electrolysis of water in an aqueous acidic solution.

2. Description of the Prior Art

As anodes for oxygen generation by electrolysis of water, there have hitherto been used in high proportions carbon electrodes as well as metal electrodes in which a metal substrate is plated with platinum or the like. These anodes have various defects in respects of oxygen resistance, corrosion resistance, economization, etc., and metal anodes which can exhibit excellent corrosion resistance particularly in acidic electrolytic solutions have not yet sufficiently been put into practice. Under such circumstances, attention has recently been drawn to lead anode as an insoluble anode having excellent corrosion resistance, dimension stability and electroconductivity even in acidic electrolyte solutions. However, it is very difficult at present to put the lead dioxide anode into practice because lead dioxide does not posses at all malleability and toughness like metals and is very brittle though lead dioxide has excellent corrosion resistance. In order to overcome these inherent defects of lead dioxide and bring the lead dioxide anode into practice, many attempts have been directed to the so-called coating type lead dioxide anodes in which a lead dioxide electrode layer is attached to an expanded metal-like, electroconductive metal substrate (e.g. expanded metal-like titanium) through an intermediate coating layer formed by platinum plating or silver plating for keeping good electrical contact while avoiding direct contact between lead dioxide and the substrate so as to cover the expanded metal-like substrate completely therewith. In this type of lead dioxide anode, the brittleness of lead dioxide itself is reduced to some extent and an electrode body per se can be formed; however its physical strength is extremely weak and the lead dioxide electrode layer is easily peeled off from the substrate even by a slight shock or bending stress. Therefore, said lead dioxide anode cannot be used as a large scale industrial electrode of filter press type and is used practically only in a small scale electrode of so-called dipping type. In order to remedy such a great disadvantage in practice that the lead dioxide electrode layer tends to peel from the substrate, such a proposal has been made that a lead dioxide electrode layer is attached to a porous substrate as if the electrode took root to the substrate. This porous substrate is roughly classified into electroconductive substrates such as graphite, porous sintered titanium and the like, and non-electroconductive substrates such as ceramics, sintered resins, and the like. Anodes using graphite as a porous electroconductive substrate are proposed in Japanese Patent Publication No. 24,313/67, Japanese Patent Application Kokai (Laid-Open) No. 18,283/70, etc. In these anodes, the peeling of the lead dioxide electrode layer from the substrate could be prevented but the substrate per se is far more brittle and cracks more easily than metallic substrates, and accordingly, the primary purpose as anode cannot be sufficiently achieved. In order to improve not only the resistance of the lead dioxide electrode layer to peeling from the substrate but also the resistance of the substrate per se to cracking, a porous sintered metal has been taken into consideration as an anode substrate, and porous sintered titanium is used as the substrate in view of the corrosion resistance thereof (see Japanese Patent Application Kokai (Laid-Open) No. 78374/79). In this case, a porous sintered titanium substrate is dipped in molten lead to fill the inner parts and openings of pores with lead and the surface of lead present at the pore opening is then anodized into lead dioxide. This anode has two problems. Firstly, not the whole outer surface of the electrode body but only lead dioxide of the pore openings function as an electrode and accordingly the actual electricity-flowing area is extremely small. Secondly, inside the pores, the lead portions contact directly with the lead dioxide portions near the surfaces, whereby lead is gradually oxidized by lead dioxide and non-electroconductive PbO layers are formed at the interfaces of the two portions, whereby it is made essentially impossible to keep good electrical contact over a long perior of time between the porous sintered titanium substrate and the lead dioxide electrode layer.

Ceramics are used as non-electroconductive porous substrates in Japanese Patent Publication No. 28743/77. This type of electrode has the practical disadvantage that physical strengths of ceramics per se are weaker than those of porous metal substrates and large flat plates of ceramics are difficult to obtain. It is also necessary to fix the terminal to the surface of the lead dioxide electrode layer through a metal plate, and this terminal portion is gradually corroded with an electrolytic solution which migrates in the dioxide layer by a capillary phenomenon to the terminal and eventually it becomes impossible for electricity to flow at the corroded portions. This is the essential disadvantage of said ceramic type electrode.

As mentioned above, there have never been any practical lead dioxide anode by which all the problems encountered in its practical application have been solved such as corrosion resistance and physical strengths of anode per se and corrosion resistance of terminal portions.

SUMMARY OF THE INVENTION

In view of the above situation, the present inventors have conducted extensive studies to put into practice a coating type lead dioxide anode. As a result, the inventors have found that all the problems for putting into practice can be solved by coating a lead dioxide electrode layer of an electroconductive, porous metal substrate through a specific intermediate coating layer.

The object of this invention is to provide a practical lead dioxide of a coating type for oxygen generation which has excellent corrosion resistance and oxygen resistance even in an acidic electrolytic solution, particularly an acidic solution containing $CN^-$ and/or $NO_3^-$ having an ability to greatly corrode even the platinum group metals and also has physical strengths and dimension stability enabling the anode to be used in an filter press type electrolytic cell on a large industrial scale.

According to this invention, there is provided an insoluble lead dioxide anode of a coating type, comprising a metal substrate with a plurality of pores, each having an opening or openings on the surface of the substrate, said substrate having coated thereon an intermediate coating layer of a metal or a metal oxide, and an electrode layer of a lead dioxide, at least both the outer surface of said substrate and the peripheral edges of the openings of the pores of said substrate being coated with the electrode layer through the intermediate coating layer.

BRIEF DESCRIPTION OF THE DRAWINGS

In the accompanying drawings.

DETAILED DESCRIPTION OF THE INVENTION

In the electrode of this invention, a porous metal is used as a substrate and a lead dioxide electrode layer is coated on at least the outer surface of the substrate as well as the peripheral edges of openings of the pores in the substrate through an intermediate coating layer of a metal or a metal oxide. It is inferred that these features of the electrode of this invention enable retention of a good and stable electrical contact for a long period of time between the substrate to which terminals can be directly fixed and the lead dioxide electrode layer coated on the substrate, and simultaneously enable one to obtain such strong physical strengths and dimensional stability that the lead dioxide electrode layer is not peeled nor broken even by various strain stresses and impacts. Such a strong bonding force between the substrate and the electrode layer that the two are not peeled seems to result from the fact that the lead dioxide electrode layer is continuously attached not only to the outer surface of the substrate but also to at least the peripheral edges of openings of pores in the substrate, and that said lead dioxide electrode layer is bonded to the substrate through an appropriate intermediate coating layer.

Figure 1:
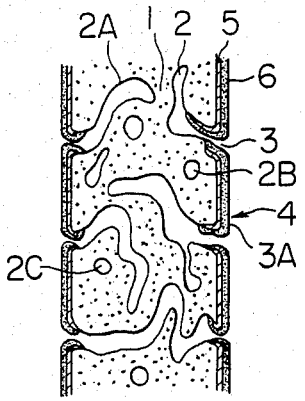
FIGS. 1 to 4 show sectional views of flanks of electrodes which are embodiments of this invention, in which 1 stands for a flat-plate-like, porous, sintered metal substrate, 2 for the interior of pore in the flat-plate-like, porous, sintered metal substrate, 2A for the inner wall surface of a pore in the flat-plate-like, porous, sintered metal substrate, 2B by the cross-section of the interior of a pore having an opening 3 at the outer surface of the flat-plate-like, porous, sintered metal substrate, 2C for the cross-section of a pore which is closed inside the flat-plate-like, porous, sintered metal substrate and which has no opening at the outer surface of the substrate, 3 for the opening of a pore in the flat-plate-like, porous, sintered metal substrate, 3A for the peripheral edge of the opening of a pore in the flat-plate-like, porous, sintered metal substrate, 4 for the outer surface of the flat-plate-like, porous, sintered metal substrate, 5 for an intermediate coating layer, and 6 for a lead dioxide electrode layer.

In FIG. 1, the lead dioxide electrode layer 6 is coated only on the outer surface 4 of the porous metal substrate 1 and the peripheral edge 3A of the opening 3 of a pore, and the intermediate coating layer 5 is interposed between this dioxide electrode layer 6 and the substrate 1. This intermediate coating layer 5 is in some cases coated on not only the outer surface 4 of the substrate 1 and the peripheral edge 3A of the opening of a pore, but also the inner wall surface 2A of the pore which is not coated with the lead dioxide electrode layer (this pore has an opening on the outer surface) (this is not shown in FIG. 1). However, when these electrodes are used as an anode in an acidic electrolytic solution containing $CN^-$ and/or $NO_3^-$ and hence having strong corrosiveness, the inner wall surfaces 2A of pores comes to be in contact with the electritic solution not only in the case where the inner wall surfaces of pores are not coated with the intermediate coating layer as in FIG. 1, but also even where the inner wall surfaces of pores are coated with the intermediate coating layer because the intermediate coating layer is gradually corroded. If the substrate is composed of a corrosion-resistant material such as titanium or a titanium alloy which is described hereinafter, the substrate surface (titanium or the titanium alloy) which is in contact with the electrolytic solution undergo anodization immediately to form a titanium oxide film of high corrosion resistance, whereby corrosion can be prevented from proceeding further. Therefore, in embodiments as shown in FIG. 1, it is preferable that the substrate is composed of titanium or a titanium alloy.

Figure 2:
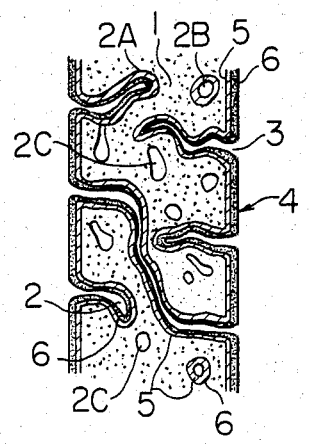

In FIG. 2, which is a preferable embodiment of the present invention, the intermediate coating layer 5 is coated on all of the outer surface 4 of the porous metal substrate 1, the peripheral edges 3A of the openings of pores and the inner wall surfaces 2A of pores, and this intermediate coating layer 5 is entirely coated with the lead dioxide electrode layer 6. The presence of the intermediate coating layer between the substrate 1 and the lead dioxide electrode layer 6 in any place results in a great decrease in the number of pin holes formed in the lead dioxide electrode layer, and also results in an increase in area which can be kept well in bonding force and electrical contact between the substrate and the lead dioxide electrode layer for a long period of time. Therefore, this embodiment of electrode is excellent in both electrode life and physical strengths.

Figure 3:
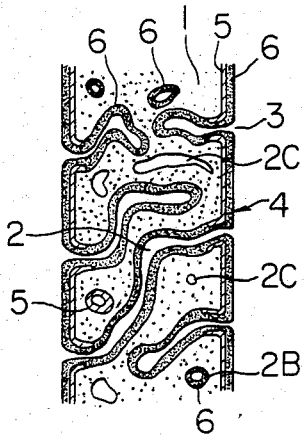

In FIG. 3, which is a similar embodiment to FIG. 2, the lead dioxide electrode layer 6 is coated on all surfaces, namely the outer surface 4 of the substrate, the peripheral edges 3A of the openings of pores and the inner wall surfaces 2A of pores having openings at the outer surface, but the intermediate coating layer 5 is interposed only at the outer surface 4 and the peripheral edges 3A of the openings of pores among all the surfaces. As a result of actual manufacturing of an electrode, the states shown in FIGS. 2 and 3 may be present together in one electrode body. Even such an electrode is by no means inferior in performances to the electrode body in which the state as shown in FIG. 2 is realized 100%.

Figure 4:
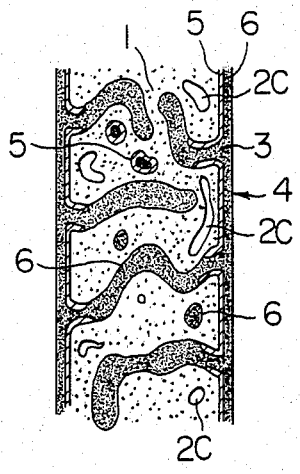

In FIG. 4, which is the best embodiment of this invention, the lead dioxide electrode layer 6 is not only coated on the outer surface 4 of the porous metal substrate 1 and the peripheral edges 3A of the openings of pores, but also fills up the interiors 2 of pores having openings 3 at the outer surface 4. As a result, the pore openings 3 are also filled with the lead dioxide electrode layer 6, and the electrode is apparently completely covered with the lead dioxide electrode layer. In this embodiment, the intermediate coating layer is present only at the outer surface 4 and the peripheral edges 3A of pore openings, and in some cases, may be present at the inner wall surfaces 2A of pores having openings at the outer surface 4. All the above embodiments are not different in corrosion resistance and physical strengths as electrode, and these are the best embodiments of this invention.

An explanation is made below of the porous metal substrate constituting the basic structure of the electrode body of this invention. The porous metal substrate of this invention refers to a metal substrate having thin and long holes, and this substrate is entirely different from a flat-plate-like metal substrate having at its surface pear-skin-like, shallow concaves and convexes formed by subjecting the smooth metal surface to etching or sand-blasting which are usually conducted as a pre-treatment in electroplating. As the porous metal substrate having the above-described pores, there may be used, for instance, so-called sintered metals obtained by heating and compressing fine metal powders, materials obtained by the metal spraying method by which a fine metal powder is pelted on the metal at an ultra-high speed through a high temperature plasma, and honeycomb-like or skeleton-like materials obtained by forming an alloy such as Raney nickel alloy into a plate, and then treating the plate by the same procedure as in the development of Rany nickel alloy. Among them, the porous sintered metals are the most preferable as the substrate of the electrode of this invention.

When a sintered metal is used as the porous metal substrate, the pores need not be perforated, though they may be perforated. In fact, for instance, in porous sintered titanium plates obtained from so-called sponge titanium by the sintering method, there are clearly present perforated pores and unperforated or closed pores together.

In the porous sintered metal substrate, irrespective of whether the pores are perforated or unperforated, its outer surface is essentially different from a rough or pear-skin-like surface obtained by subjecting an ordinary metal material having a smooth surface to etching or sand-blasting. That is to say, the surface obtained by etching a metal material having a smooth surface with an acid or the like, has an innumerable number of pores formed by corrosion, and the edges of the openings of the pores have relatively sharp corners and hence are angular. The ratio of pore depth (L) to the caliber (D) of the pore, namely L/D, is relatively small and is presumed to be less than 1 and at most 5. Also, in the case of the so-called pear-skin-like surface obtained by so-called sand-blasting the L/D is smaller than that of the above etched surface and the shape of pores is different from that in the case of etching, and very smooth concaves and convexes succeed. On the other hand, in the case of the porous metal used as the substrate of the electrode of this invention, the peripheral edges of the pore openings are not sharp as in the case of etching reflecting the shape of the original metal powder as can also be inferred from the fact that the substrate is generally obtained by sintering a fine metal powder or by spraying a metal, but are not too smooth as in the case of sand-blasting, and have both appropriate sharpness and roundness. In the case of porous metals, the calibers of pores are widely distributed in the range of from about several microns to about 0.5 mm, while the pore depths are far larger than calibers of the pores as is apparent from the fact that perforated pores exist. Accordingly, there are substantially no pores having a L/D of less than 1, and even pores having a caliber of several microns have a L/D of about 10 and such perforated pores that their openings can be observed with the naked eye, which pores have a caliber of 0.05 to 0.1 mm, have a L/D of more than 10 even when the thickness of the substrate is 1 to 2 mm. Therefore, considering that there are no straight perforated pores (namely, no perforated pores in the optical sense), the L/D seems to be distributed in a wide range of about 10 to about 200.

When a lead dioxide electrode is actually prepared using a substrate formed by sufficiently etching a conventional smooth metal plate (for example, titanium plate) or sand-blasting the same to convert the surface to a pear-skin-like surface, the resulting electrode has physical properties so different from those of the electrode of this invention that when only a slight bending force is applied to the former the lead dioxide electrode layer is immediately remarkably cracked and pealed, and hence, the former cannot be used in practice. The causes for this difference in peelability have not sufficiently been clarified. However, it is presumed that the distribution range of L/D differs greatly between the porous metal substrate and the etching-treated or sand-blast-treated substrate, and that the pores of the porous metal substrate are thin and deep while the pores of the latter are thick and shallow and accordingly the coated lead dioxide electrode layer is quite different in how to take root into respective substrates, which will results in a large difference in bonding force between the substrate and the electrode layer. Moreover, it is also assumed that the difference in shape of edge of pore openings affects the moderation of strain of crystal characteristic of lead dioxide, and both the appropriate roundness of the edges of pore openings and the extremely narrow distance between the pore openings (there are as many fine pores having a large L/D) in the case of porous substrate, serve to moderate the strain of crystal of lead dioxide, which results in a strong bonding force between the substrate and the electrode.

When a lead dioxide electrode layer is anchored to the concaves and convexes having a small L/D formed by such a surface treatment as etching, sand-blasting or the like, this anchoring has fair resistance to shear stress parallel to the substrate surface and compression stress to the surface, but has substantially no resistance to peeling stress having a vector in the direction perpendicular to the substrate surface caused by an impact due to collision. On the other hand, the advantages of using, as in the electrode of this invention, a porous metal substrate having an innumerable number of fine pores having openings at the outer surface of the substrate, which pores are labyrinthine and have a large L/D value, for enhancing the peelability physically, can by no means be achieved by surface treatment of a conventional flat-plate-like metal substrate. Of course, there is no objection to further etching the porous metal substrate without damaging the feature that the L/D value is large and also without reducing the physical strengths.

Basically, the material of the porous metal substrate is not critical and there may be used any metal material which is excellent in corrosion resistance in an acidic, electrolytic solution when not electrified, and can be formed into a porous structure. As the metal material meeting these requirements, there may be used titanium, zirconium and their alloys. Among them, in respects of being easily sintered and formed by a rolling method or the like and being a general purpose material, preferred is pure titanium obtained from conventional spongy titanium from the practical point of view that large electrodes (for instance, 50 to 100 cm in width and 100 to 200 cm in length are produced).

The porosity of the porous metal substrate {(1−apparent density of molded substrate/true density of the substrate)×100} is preferably 5 to 50%, more preferably 20 to 40%. When the porosity is outside this range, the substrate have too many pores to have sufficient physical strengths, or too few pores to obtain a strong bonding force to the lead dioxide electrode layer because the substrate becomes very close to a conventional non-porous material.

The calibers of pores at openings (3 in FIG. 1) of the porous metal substrate have a wide distribution in the range of several microns to about 0.5 mm in the case of, for example, a porous sintered titanium plate formed by a conventional production method. However, outside this range, there cannot be obtained a strong bonding force between the substrate and the electrode layer, which is attained by the continuous adhesion of the lead dioxide electrode due to the lead dioxide electrode layer 6 being attached continuously to at least the outer surface 4 and the peripheral edges 3A of the openings of pores in the porous substrate 1. Accordingly, the word "porous" used herein does not include forms called "expanded metal" or "mesh" in the conventional sense, but does include, as a matter of course, materials having a porosity within the above-mentioned range even if it has an expanded metal form in appearance.

The thickness of the porous metal substrate is not critical in the production of the insoluble lead dioxide anode of this invention. However, when the substrate is used as an electrode substrate for an electrolytic cell in which there is a possibility of a stress being applied to the electrode plate, such as a filter press type electrolytic cell, it is practically required that the substrate per se have a sufficient flexural strength against the stress. For this purpose, the thickness is at least 1 mm, preferably about 2 to 10 mm. Too large a thickness requires a large scale electrolytic cell, and accordingly an expensive material for the intermediate coating layer as well as lead dioxide becomes required in unnecessarily large quantity which is valuless from the practical standpoint.

When the porous metal substrate having the above-described material, structure and shape is used, an advantage can be obtained with respect to providing terminals, which has never been achieved by the use of a porous ceramic or graphite.

That is to say, in the case of substrates made of a non-conductive material such as ceramic or a material to which a terminal metal (bus-bar) cannot be welded directly even though it is a good conductor there are various difficult problems with respect to fixation of bus-bar. On the other hand, when a porous metal is used as the substrate, the metal per se is excellent electroconductive material, and hence, terminals can be drawn directly from the substrate, and it is possible to firmly fix the bus-bar by a conventional welding technique. Therefore, even if a corrosive electrolytic solution penetrates the lead dioxide electrode layer and migrates in the porous metal substrate owing to capillarity to contact the bus-bar fixing portion, there is no fear that the electrical contact between the bus-bar and the metal substrate may be impaired because of the intrinsic corrosion resistance of the metal material (e.g. titanium), and therefore, a good contact can be kept for a long period of time. Such an advantage can not be by any means achieved by using a ceramic or graphite substrate. Unless the electrical contact between the bus-bar and the metal substrate is kept for a long period of time, clearly the electrode body has no practical value even if the electrical contact and bonding force between the metal substrate and the lead dioxide electrode layer are kept good for a long period of time.

The intermediate coating layer in the electrode of this invention is indispensable for the following purposes. That is to say, the intermediate coating layer is used in order to (1) reduce the electrical contact resistance between the porous metal substrate and the lead dioxide electrode layer and maintain good electroconductivity for a long period of time, (2) form a strong bonding force between the porous metal substrate and the lead dioxide electrode layer, and (3) prevent the porous metal substrate from being contacted with an electrolytic solution which penetrates through very few pin holes or the like in the lead dioxide eleectrode layer, and to supplement the anti-corrosion effect of the lead dioxide electrode layer against the substrate.

The intermediate coating layer can attain the above purposes by being composed of a metal or a metal oxide. It is preferable that the layer be mainly composed of a platinum group element (Ru, Rh, Pd, Ir, Os or Pt) or an oxide thereof or an oxide of a mixture of said platinum group element and Ta, because these materials are excellent in retention of electroconductivity, reduction of contact resistance, bonding force between the substrate and the lead dioxide electrode layer, supplementation of anti-corrosive effect. In this case, the term "mainly composed" means that a metal or an oxide of the above-mentioned platinum group element occupies more than 50%, preferably at least 80% of the intermediate coating layer components. It is more preferable that among the above-mentioned metals and oxides of the platinum group elements, platinum, platinum oxide, palladium, or palladium oxide alone or an oxide of a mixture of iridium or ruthenium and tantalum constitutes the intermediate coating layer. Metals such as silver, gold, copper, aluminum and the like may be added in small quantities to the above platinum group metals. The metals to be contained in a major amount are characterized in that they are unsusceptible to oxidation by a contact with lead dioxide for a long period of time, and their oxides possess relatively good electroconductivity. Lead is not said to be a preferable intermediate coating layer because it tends to form a non-electroconductive oxide by contact with lead dioxide.

The thickness of the intermediate coating layer is not critical for the above purposes. However, if the intermediate coating layer is applied in such a thickness as to cover openings (3 in FIG. 1) of pores at the outer surface of the porous metal substrate, the bonding force between the substrate and the lead dioxide electrode layre is impaired, and accordingly, the thickness of the intermediate coating layer is enevitably limited. Specifically, the maximum thickness of the intermediate coating layer should be $\frac{1}{2}$ of the maximum caliber of pore openings and, usually, the thickness is suitably about 1/10 to 1/100 of the maximum thickness. More specifically, the thickness of the intermediate coating layer is appropriately about 0.1 to 20$\mu$, preferably about 0.5 to 10$\mu$, considering practical points, such as cost of intermediate layer material and productivity of coating operation. When the thickness is larger than this range, there is no practical advantage because the effects of increase in thickness are not conspicuous compared with increased cost and decreased productivity.

An explanation is made below about the lead dioxide electrode layer which functions as an electrode in the coating type electrode body of this invention.

The feature of the electrode body of this invention lies in the structure that at least both the outer surface 4 of the porous metal substrate 1 and the peripheral edges 3A of the openings of pores are coated with the lead dioxide electrode layer through the intermediate coating layer. With this structure, there is greatly improved the most serious conventional problem that the lead dioxide electrode layer is easily peeled off from the substrate, and simultaneously, the corrosion resistance of the electrode body as well as the maintenance of good electroconductivity between the substrate and the electrode layer for a long period of time can be achieved at a high level. In the sense of further enhancing the above effects brought by the above described structure, it is preferred that the inner wall surfaces 2A of the pores are also coated with the lead dioxide electrode layer 6 as in FIG. 2 or 3, and it is more preferable that the inner parts of the pores are filled with the lead dioxide electrode layer as in FIG. 4, whereby the contact of the electrode with an electrolytic solution is effected only at the outer surface of the electrode. The lead dioxide electrode layer is composed of the lead dioxide chemically known as $\alpha$-$PbO_2$ and $\beta$-$PbO_2$. Although $\alpha$-$PbO_2$ and $\beta$-$PbO_2$ somewhat differ in electroconductivity, corrosion resistance, crystal strain, etc., both the $\alpha$- and $\beta$-forms may be used with the same effect in the electrode structure of this invention. However, in view of workability in manufacturing the electrode, it is preferable that the outer surface of the substrate and the peripheral edges 3A of the openings of the pores are coated mainly with $\beta$-$PbO_2$ and the interiors 2 or the inner wall surfaces 2A of the pores are coated mainly with $\alpha$-$PbO_2$. Specifically explaining, a thick coating layer of $\beta$-$PbO_2$ is easily obtained, for instance, by anodic electrodeposition in an acidic, electrolytic bath of a lead salt such as $Pb(NO_3)_2$, however when the porous metal of this invention is used as the substrate, it is difficult to form the $\beta$-$PbO_2$ coating layer having the same thickness and uniformity as on the outer surface of the substrate in the interiors 2 of the pores or on the inner wall surfaces 2A of the pores. This necessitates that the coating of $\beta$-$PbO_2$ be restricted mainly to the outer surface 4 of the substrate and the peripheral edges 3A of the openings of the pores. On the other hand, $\alpha$-$PbO_2$ is obtained, for instance, by anodic electrodeposition in a basic, electrolytic bath of a lead salt such as basic lead carbonate or by oxidation of a lead salt such as $Pb(NO_3)_2$ with an oxidizing agent. However, a relatively long period of time is required to form a thick coating layer of $\alpha$-$PbO_2$. Accordingly, $\alpha$-$PbO_2$ not is suitable for forming a thick coating layer on the outer surface of the substrate and the peripheral edges of the openings of pores. It is preferable to coat the inner wall surfaces 2A of pores and fill the interiors 2 of pores with $\alpha$-$PbO_2$ by oxidation of a lead salt with an oxidizing agent, because when an electrodeposition method is used the throwing power is low and hence said method is convenient.

The lead dioxide electrode layer on the outer surface need not be so thick from in respect of consumption of the electrode layer itself, because lead dioxide itself is very excellent in corrosion resistance in acidic electrolytic solutions as compared with other various electrode materials. However, when $\beta$-$PbO_2$ is electrodeposited to form the lead dioxide electrode layer on the outer surface of the substrate for the reasons described above, slightly more pin holes are formed than $\alpha$-$PbO_2$, and hence, there is a fear that the electrolytic solution penetrates the electrode layer little by little during use over a long period of time and, to corrode and wasted the intermediate coating layer if some material is used as the intermediate layer. Hence, too thin an electrode layer is not adequate from the standpoint of preventing the penetration of the electrolytic solution. Too thick an electrode layer is, however, not necessarily better. That is to say, with too thick a $\beta$-$PbO_2$ layer, various problems arise such as (a) the $\beta$-$PbO_2$ layer itself becomes brittle due to electrodeposition strain, (b) the economic efficiency in the manufacture of electrode becomes low, and (c) knot-like protrusions are liable to be formed on the $\beta$-$PbO_2$ layer surface, whereby the surface smoothness is reduced. For these reasons, the thickness of the lead dioxide electrode layer is preferably within the range of about 0.1 to 4.0 mm, more preferably about 0.2 to 1.0 mm from the practical point of view. It is another feature of this invention that excellent corrosion resistance is obtained even with such a thin lead dioxide electrode layer. When the $\beta$-$PbO_2$ coating is formed by electrodeposition, even if the thickness of the coating has the above-mentioned thickness, there are, microscopically, many small knot-like projections on its surface, and hence, the surface cannot be said to be mirror-like. If the electrode surface is, however, required to be smooth for sealing the electrolytic solution in actual usage, the surface can be finished to a smooth surface by an ordinary mechanical processing.

As an effective means for solving the problem of pin holes in the $\beta$-$PbO_2$ layer formed by electrodeposition, a thin layer of $\alpha$-$PbO_2$ having less pin holes may be interposed between the intermediate coating layer 5 and the $\beta$-$PbO_2$ layer or between the inner wall surfaces 2A of pores in the porous metal substrate and the $\beta$-$PbO_2$ layer, or the $\beta$-$PbO_2$ layer may be replaced by an $\alpha$-$PbO_2$-$\beta$-$PbO_2$ alternate multiple-layer structure. The interposition of this $\alpha$-$PbO_2$ layer enables the further enhancement of the corrosion resistance of the electrode body without impairing the bonding force between the lead dioxide electrode layer and the substrate and also makes the life of the electrode substantially semipermanent.

The electrode of this invention can be manufactured by various known methods.

That is to say, in coating the porous metal substrate with the intermediate coating layer of a metal or metal oxide, an ordinary electroplating method may be used as the easiest method when, as in FIGS. 1, 3 or 4, the outer surface 4 of the substrate and the peripheral edges 3A of the openings of pores are coated. When it is intended to coat even the inner wall surfaces 2A of pores as in FIG. 2, there can be used, for instance, a so-called electroless plating method and a baking method by which an alcholic solution of an inorganic salt of said metal is coated on the substrate, the resulting coating is reduced with hydrazine, or the like, and the reduced coating is repeatedly baked in a reducing flame.

In coating the intermediate coating layer-coated porous metal substrate with the lead dioxide electrode layer, as previously outlined, there may be used, for instance, an electrodeposition method by which an anode of the porous metal substrate coated with the intermediate coating layer and a cathode such as a titanium plate are placed in an acidic electrolytic bath of a lead salt such as $Pb(NO_3)_2$ and electrolysis is conducted at a current density in the range of from 0.01 to 10 $A/dm^2$; a chemical method by which $\alpha$-$PbO_2$ is coated on the intermediate coating layer-coated porous metal substrate by dipping the above substrate in an aqueous solution of a lead salt such as $Pb(NO_3)_2$, drying the substrate to attach the lead salt to the substrate surface and then oxidizing the lead salt in an aqueous ammoniacal per sulfate solution; and a combination of the electrodeposition method and the chemical method. The interiors of the pores in the substrate can easily be filled with lead dioxide by repeating the above chemical method. In this case, through the outer surface of the substrate is finally coated with $\beta$-$PbO_2$ by electrodeposition, the order of the filling of the interiors of the pores by the chemical method and the coating of the outer surface of the substrate by the electrodeposition method is not critical, and the desired electrode body can be produced in either order, and the electrode bodies obtained have the same performances irrespective of the above order.

The coating type insoluble lead dioxide anode of this invention will be explained below in more detail referring to Examples and Comparative Examples. As is obvious from these Examples, the peeling of the lead dioxide electrode layer from the substrate due to physical and electrical factors is prevented very effectively by the basic structure of this invention in which a porous metal is used as the substrate and a lead dioxide electrode layer is continuously coated on at least the outer surface of the substrate and the peripheral edges of the openings of pores through an intermediate coating layer consisting of a metal or a metal oxide. The above effect is obvious from comparison between the Examples of this invention and the Comparative Examples. That is to say, when an ordinary expanded metal-like metal or a ceramic is used as the substrate, the physical strengths of the electrode are extremely poor. Even if a porous metal (sintered titanium) is used as the substrate, an electrode having the structure in which the lead dioxide electrode layer is directly coated on the substrate, is far inferior to the electrode having the structure of this invention is electrode life under electrification. That is to say, by adopting the structure of this invention, the electrode life is extended to 10 to 20 times that of conventional lead dioxide electrodes, and the physical strengths of the electrode are also improved quite surprisingly. Therefore, it can be said that the lead dioxide anodes known in literature as insoluble anodes have become for the first time a practical electrode applicable even to filter press type electrolytic cells.

PREFERRED EMBODIMENTS OF THE INVENTION

In the following Examples and Comparative Examples, the electrode life under electrification and physical strengths of each electrode were evaluated by the following methods. The electrode life was tested by using an aqueous $5NH_2SO_4$ solution containing 100 ppm of $CN^-$ and 5,000 ppm of $NO_3^-$ as an electrolytic solution, an electrode in each Example or Comparative Example as anode and a titanium plate as cathode in an electrolytic cell, and continuously conducting a constant current electrolysis at an anode current density of 100 A/dm$^2$ at a temperature of 50° to 60° C. The life was determined when the terminal voltage had remarkably increased or the lead dioxide electrode layer had strikingly peeled. The physical strengths were evaluated by causing the electrode to naturally fall from a height of 1.5 m on a concrete floor and visually determining the degree of the damage according to six ratings.

The Examples are merely by way of illustration and not by way of limitation.

EXAMPLE 1 TO 6 AND COMPARATIVE EXAMPLES 1 TO 5

A porous sintered titanium plate (porosity: 25–30%) was used as a porous metal substrate. This was formed into a piece having a size of 50 mm×100 mm×2 mm$^t$, and a titanium bar having a diameter of 2 mm was directly welded as a terminal to the center of one of the faces of 50 mm×2 mm and 100 mm×2 mm of the piece. Alternatively, said porous sintered titanium plate piece was inserted into the hole of a size of 50 mm×100 mm punched at the center of a titanium plate having a size of 100 mm×300 mm×5 mm$^t$, and welded to the titanium plate (one end of said titanium plate was formed into a bus-bar for the terminal). The resulting assembly had a shape suitable to the $PbO_2$ electrodeposition and evaluation of the finished electrode under electrification.

An intermediate coating layer was coated on the porous sintered titanium plate as follows: In the case of the Pd intermediate coating layer, a solution of palladium chloride in hydrochloric acid/n-butanol (hereinafter referred to as "coating solution") was applied to the degreased porous sintered titanium plate, and dried, after which the coated plate was subjected to heat-treatment at about 200° C. for 10 seconds in a reducing flame of propane gas, cooled, coated with 50% aqueous solution of hydrazine hydrate as a reducing agent, dried and then heated at about 200° C. for about 1 min in a reducing flame. This cycle was repeated about 10 times. Thus, a Pd intermediate coating layer having a thickness of about 2$\mu$ was formed on the titanium plate.

In the case of the oxide intermediate coating layer of, for instance, PdO, $IrO_2+Ta_2O_5$, or $RuO_2+Ta_2O_5$, the intermediate coating layer was formed on the porous sintered titanium plate by coating the degreased porous sintered titanium plate with a solution of $PdCl_2$, $IrCl_4+TaCl_5$ or $RuCl_4.3H_2O+TaCl_5$, respectively, in hydrochloric acid/n-butanol or hydrochloric acid/ethanol as a coating solution, and baking the coated plate for about 5 min in an oxidizing flame at 500° to 600° C., repeating this coating-baking cycle about 10 to 15 times, and then finally burning the plate for 1 hr in the above oxidizing flame.

The above two methods of forming the intermediate layer are referred to as "baking method".

The Pt intermediate coating layer was formed by ordinary electroplating in a chloroplatinic acid/phosphate bath. The Pd intermediate coating layer by electroless plating was formed by ordinary electroless plating using palladium sulfate and $NaH_2PO_4$.

The $\beta$-$PbO_2$ electrode layer was formed by electrodeposition in the following manner on the porous sintered titanium substrate, coated with the intermediate coating layer or on the porous sintered substrate coated with the intermediate coating layer and further coated with the $\alpha$-$PbO_2$ electrode layer mentioned below.

That is to say, the $\beta$-$PbO_2$ electrode layer was formed as follows: A fast $\beta$-$PbO_2$ electrode layer having a thickness of 0.1 to 0.5 mm was formed on the porous sintered titanium plate coated with the intermediate coating layer by conducting electrodeposition at a current density of 1 A/dm$^2$ at room temperature in an electrolytic bath containing an aqueous solution of 0.5 mole/liter of $Pb(NO_3)_2$ adjusted always to a pH of 2.0 with basic lead carbonate in which bath SUS-27 plate was placed as the cathode and the above porous sintered titanium plate was placed as the anode.

The $\alpha$-$PbO_2$ electrode layer was formed by a chemical method in the following manner on the porous sintered titanium substrate coated with the intermediate coating layer, or on the porous sintered titanium substrate coated with the intermediate coating layer and further coated with the $\beta$-$PbO_2$ electrode layer: The said substrate was dipped in a saturated aqueous solution of $Pb(NO_3)_2$ kept at room temperature, the system was deaerated by suction to thoroughly penetrate the solution into the pores in the substrate; the substrate was further dipped in a saturated aqueous solution of $Pb(NO_3)_2$ kept at 90° C.; and then dipped in an aqueous ammoniacal solution of ammonium persulfate kept at 50° to 60° C. for about 20 min to form an $\alpha$-$PbO_2$ layer on the surface of the substrate. If necessary, these steps were repeated to thicken the $\alpha$-$PbO_2$ layer. Finally, the substrate was washed with 7% $HNO_3$, and then with a stream of pure water for at least 24 hrs and then dried.

If necessary, the above two methods were used alternately to form on the substrate a multi-layered $PbO_2$ electrode layer in which the $\alpha$-$PbO_2$ layer and the $\beta$-$PbO_2$ layer were put on each other (Examples 2, 3, 5 and 6).

In each of the above cases, two or more electrodes were prepared according to the above procedure. One of them was used for physical strength tests, the main test of which was a measurement of bonding strength between the $PbO_2$ electrode layer and the substrate by a falling test, and the others were used for evaluation of performance under electrification.

Various $PbO_2$ electrodes produced by the above procedure provided with the constructive requirements of this invention as well as their performance evaluations are summarized in Table 1.

TABLE 1

| | Preparation of electrode | | | | | |
|---|---|---|---|---|---|---|
| | | | (II) Intermediate coating layer | | (III) $PbO_2$ electrode layer | |
| | (I) Substrate | | | | | |
| | Material | Shape | Material (Method of manufacture) | Area of coating | Material (Method of manufacture) | Area of coating ($PbO_2$ thickness in 4 of the drawing) |
| Example 1 | Porous sintered titanium | Plate | Palladium (Baking method) | 3A and 4 in FIG. 1 | $\beta$-$PbO_2$ (Electrodeposition method) | 3A and 4 in FIG. 1 (0.2 mm) |
| Comparative Example 1 | Ordinary titanium (non-porous) | Lath shape (Etching applied) | Palladium (Baking method) | Whole surface of lath | $\beta$-$PbO_2$ (Electrodeposition method) | Whole surface of lath (0.2 mm) |
| Comparative Example 2 | Corrundum type ceramic | Bar (150 mmD × 250 mmL) | | | $\alpha$-$PbO_2$ . . . Only outer surface of substrate (Chemical method) $\beta$-$PbO_2$ . . . On $\alpha$-$PbO_2$ (Electrodeposition method) | |
| Comparative Example 3 | Porous sintered titanium | Plate | | | $\beta$-$PbO_2$ (Electrodeposition method) | 3A and 4 in FIG. 1 (0.2 mm) |
| Comparative Example 4 | Porous sintered titanium | Plate | Palladium (Baking method) | 3A and 4 in FIG. 1 | | |
| Example 2 | Porous sintered titanium | Plate | Platinum (Electroplating method) | 3A and 4 in FIG. 3 | $\alpha PbO_2$ (anterior) (Chemical method) $\beta$-$PbO_2$ (posterior) (Electrodeposition method) | 2A, 3A, and 4 in FIG. 3 (0.4 mm) |
| Example 3 | Porous sintered titanium | Plate | Palladium oxide (Baking method) | 3A and 4 in FIG. 1 | $\alpha PbO_2$ (anterior) (Chemical method) $\beta$-$PbO_2$ (posterior) (Electrodeposition method) | 3A and 4 in FIG. 1 (0.5 mm) |
| Example 4 | Porous sintered titanium | Plate | Palladium (Electroless plating method) | 2A, 3A and 4 in FIG. 2 | $\beta$-$PbO_2$ (Electrodeposition method) | 2A, 3A and 4 in FIG. 2 (0.1 mm) |
| Example 5 | Porous sintered titanium | Plate | $IrO_2 + Ta_2O_5$ (Baking method) | 3A and 4 in FIG. 1 | $\alpha$-$PbO_2$ (posterior) (Chemical method) $\beta$-$PbO_2$ (anterior) (Electrodeposition method) The above methods were alternately repeated twice to form 4 layers. | 3A and 4 in FIG. 1 (0.3 mm) |
| Example 6 | Porous sintered titanium | Plate | Palladium (Baking method) | 3A and 4 in FIG. 4 | $\alpha$-$PbO_2$ (anterior) (Chemical method) $\beta$-$PbO_2$ (posterior) (Electrodeposition methods) The above methods were alternately repeated thrice to form 6 layers. | 2, 3A and 4 in FIG. 4 (0.5 mm) |
| Example 7 | Porous sintered titanium | Plate | $RuO_2 + Ta_2O_5$ (Baking method) | 3A and 4 in FIG. 1 | $\beta$-$PbO_2$ (Electrodeposition method) | 3A and 4 in FIG. 1 (0.2 mm) |
| Comparative Example 5 | Porous sintered titanium | Plate | $RuO_2 + TiO_2$ (Baking method) | 3A and 4 in FIG. 1 | $\beta$-$PbO_2$ (Electrodeposition method) | 3A and 4 in FIG. 1 (0.2 mm) |

| | Evaluation of electrode | | |
|---|---|---|---|
| | Life under electrification | | |
| | Life and change in condition | Consumption rate | Peeling of $PbO_2$ layer in falling test |

TABLE 1-continued

| | of electrode | of electrode | Evaluation | Remarks |
|---|---|---|---|---|
| Example 1 | More than 8,000 hrs. Neither voltage rise nor peeling. | less than 0.005 mg/A · hr | | Only the area which hit the floor was peeled very slightly. |
| Comparative Example 1 | Peeled in edgy portions in 200 hrs. No voltage rise for more than 2,000 hrs. | less than 0.12 mg/A · hr | X X | $PbO_2$ peeled almost completely from the Ti lath of substrate. |
| Comparative Example 2 | In about 200 hrs., $PbO_2$ surface was powdered and peeled little by little. In 510 hrs., electrification became impossible owing to corrosion of the terminal portion. | 0.07 mg/A · hr | X | Ceramic substrate was broken but peeling of $PbO_2$ from the ceramic substrate was slight. |
| Comparative Example 3 | In 2 hrs., voltage increased and layer peeled with violent sparkles. | | Δ | The area which hit the floor and its surrounding parts peeled slightly. |
| Comparative Example 4 | In 15 min., voltage increased and electrification became impossible. | | | |
| Example 2 | More than 8,000 hrs. Neither voltage rise nor peeling. | Less than 0.005 mg/A · hr | | Only the area which hit the floor was peeled slightly. |
| Example 3 | More than 8,000 hrs. Neither voltage rise nor peeling. | Less than 0.005 mg/A · hr | | Only the area which hit the floor was peeled slightly. |
| Example 4 | More than 8,000 hrs. Neither voltage rise nor peeling. | Less than 0.005 mg/A · hr | | Only the area which hit the floor was peeled very slightly. |
| Example 5 | More than 8,000 hrs. Neither voltage rise nor peeling. | Less than 0.005 mg/A · hr | | Only the area which hit the floor was peeled very slightly. |
| Example 6 | More than 8,000 hrs. Neither voltage rise nor peeling. | Less than 0.005 mg/A · hr | | Even the area which hit the floor was hardly peeled |
| Example 7 | More than 8,000 hrs. Neither voltage rise nor peeling | Less than 0.005 mg/A · hr | | Only the area which hit the floor was peeled very slightly. |
| Comparative Example 5 | In 254 hr., voltage increased and layer peeled with violent sparkles. | | | Only the area which hit the floor was peeled slightly. |

What is claimed is:

1. A coating type insoluble lead dioxide anode comprising a porous metal substrate consisting of titanium, zirconium or an alloy thereof with a plurality of pores, each having an opening or openings on the surface of the substrate, said substrate having directly coated thereon an intermediate coating layer composed mainly of a platinum group metal or an oxide thereof and an electrode layer of a lead dioxide, at least both the outer surface of the substrate and the peripheral edges of the openings of pores in the substrate being coated with the electrode layer through the intermediate layer.

2. A coating type insoluble lead dioxide anode according to claim 1, wherein the inner wall surfaces of the said pores are coated with the intermediate coating layer composed mainly of a platinum group metal or an oxide thereof.

3. A coating type insoluble lead dioxide anode according to claim 1, wherein the inner wall surfaces of the said pores are coated with the lead dioxide electrode layer.

4. A coating type insoluble lead dioxide anode according to claim 1, wherein the inner wall surfaces of the said pores are coated with the lead dioxide electrode layer through the intermediate coating layer composed mainly of a platinum group metal or an oxide thereof.

5. A coating type insoluble lead dioxide anode according to claim 1 or 2, wherein the interiors of the said pores are filled with lead dioxide.

6. A coating type insoluble lead dioxide anode according to claim 1, wherein only the outer surface of the substrate and the peripheral edges of the openings of pores in the substrate are coated with the lead dioxide electrode layer through the intermediate coating layer composed mainly of a platinum group metal or an oxide thereof.

7. A coating type insoluble lead dioxide anode according to claim 1, wherein the porous metal substrate is a flat-plate-like or expanded metal-like, porous, sintered metal material.

8. A coating type insoluble lead dioxide anode according to claim 1 or 7, wherein the porous metal substrate is of titanium or a titanium alloy and has a porosity of 5 to 50%.

9. A coating type insoluble lead dioxide anode according to claim 1, 3, 4 or 6, wherein the lead dioxide electrode layer is composed mainly of $\beta$-$PbO_2$ or $\alpha$-$PbO_2$ or a multi-layer of $\alpha$-$PbO_2$ and $\beta$-$PbO_2$.

10. A coating type insoluble lead dioxide anode according to claim 1, wherein the ratio of the pore depth (L) to the caliber (D) of the pores in the substrate is in the range of about 10 to about 200.

11. A coating type insoluble lead dioxide anode comprising a porous metal substrate consisting of titanium, zirconium or an alloy thereof with a plurality of pores, each having an opening or openings on the surface of the substrate, said substrate having directly coated thereon an intermediate coating layer composed mainly of a platinum group metal or an oxide thereof or an oxide of a mixture of said platinum group metal and Ta, and an electrode layer of lead dioxide; at least both the outer surfaces of the substrate and the peripheral edges of the openings of the pores in the substrate being coated with the electrode layer through the intermediate layer.

* * * * *